United States Patent [19]

Britton

[11] Patent Number: 4,787,870

[45] Date of Patent: Nov. 29, 1988

[54] PROPELLER CLEARING MEANS

[75] Inventor: John D. Britton, Lymington, England

[73] Assignee: Herco David Limited, Reading, England

[21] Appl. No.: 109,953

[22] Filed: Oct. 19, 1987

[30] Foreign Application Priority Data

Nov. 17, 1986 [GB] United Kingdom ..... 8627444

[51] Int. Cl.[4] ..... B63H 19/00

[52] U.S. Cl. ..... 440/113; 114/66

[58] Field of Search ..... 440/49, 73, 112, 113; 114/66, 173, 174–178, 197; 441/135

[56] References Cited

U.S. PATENT DOCUMENTS

| | | | |
|---|---|---|---|
| 1,763,464 | 6/1930 | Gunderson et al. | 114/66 |
| 2,360,554 | 10/1944 | Englert | 114/178 |
| 3,565,031 | 2/1971 | De Persia | 114/197 |
| 3,842,784 | 10/1974 | Nelson | 114/173 |
| 4,376,418 | 3/1983 | Childs | 114/178 |

*Primary Examiner*—Joseph F. Peters, Jr.
*Assistant Examiner*—Jesus D. Sotelo
*Attorney, Agent, or Firm*—Barnes & Thornburg

[57] ABSTRACT

The invention provides means to enable the propeller of a power driven watercraft to be viewed and cleared of any fouling material by access from the interior of the craft; suitably the propeller is viewed through and access is gained by means of a pierceable transparent diaphragm (7) set in a tube (2) which is inserted through and sealably attached to an aperture formed in the hull (1) of the craft immediately above the propeller.

5 Claims, 1 Drawing Sheet

PROPELLER CLEARING MEANS

Figure 1:
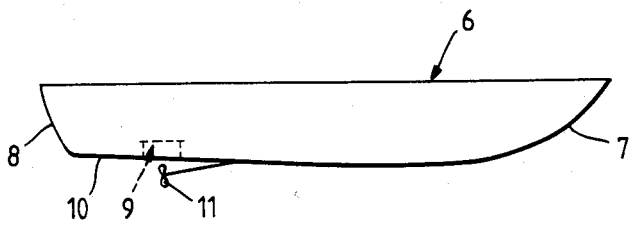

The present invention relates to a means to enable the propeller of a power driven watercraft to be cleared of debris.

Power driven watercraft are usually driven by one or more motor or engine which may drive a propeller or propellers. A propeller is susceptible to fouling, particularly in inland and coastal waters, and stretches of water which carry a great deal of traffic. For example, of propeller may have weed, rags or lines wrapped around it which can cause it to stop, and require someone to dive under the craft to remove the offending material.

The present invention provides a construction for clearing a propeller of a watercraft, said construction being adapted to fit an aperture formed in the hull, immediately above the propeller of the watercraft, the construction comprising a peripheral wall defining a tube, having an upper and lower end, means for sealably attaching the tube to extend inwardly through the aperture in the hull and one or more transparent panels extending across and sealing the lower end of the tube and allowing viewing of the propeller and access to the propeller via the tube.

Using the construction of the present invention it is possible to view the propeller from the interior of the watercraft, to ascertain what, if anything, is fouling the propeller and to gain access to the propeller from the interior of the craft, e.g. whilst the craft is in the water, and to remove any fouling material.

When it is seen that debris is fouling the propeller, access may be gained to the propeller via this transparent panel or panels and the debris may be removed. The panel or panels providing access to the propeller may be e.g. solid transparent panels which are hinged or otherwise movably attached to the tube, or, preferably, a single transparent pierceable diaphragm covering the end of the tube. Preferably, the panel is such that cutting means e.g. a hack-saw or knife blade attached to a suitable mount may be inserted into the water to cut the rope or other debris away from the propeller.

In an alternative embodiment the construction is such that a fixed transparent panel through which the propeller may be viewed is placed close to the tube through which access to the propeller may be gained. A blade or other cutting means may then be inserted into the water via a movable or pierceable panel or panels in the tube, and the debris cut away from the propeller, using the transparent viewing panel for guidance in cutting.

Once the propeller has been freed from debris and the cutting means withdrawn from the water, the panels may be placed back in their original position, or, in the case of a pierceable diaphragm, the diaphragm may be substantially self sealing.

The construction may be fitted to existing craft or may form an integral part of a craft. Accordingly, the present invention also provides a watercraft provided with a propeller in which a construction as described above is attached to an aperture formed in the hull of the craft immediately above the propeller.

The present invention further provides a watercraft comprising a hull, a propeller located below a portion of the hull, an aperture formed in the hull immediately above said propeller, a peripheral wall defining a tube having an upper end and a lower end, means sealingly connecting the lower end of said tube to said hull, with the peripheral wall sealingly surrounding said aperture, and the wall extending upwardly and inwardly of the hull, and at least one transparent panel extending across and sealing the lower end of the tube, effective to allow viewing of the propeller and access to the propeller via the tube.

Figure 2:
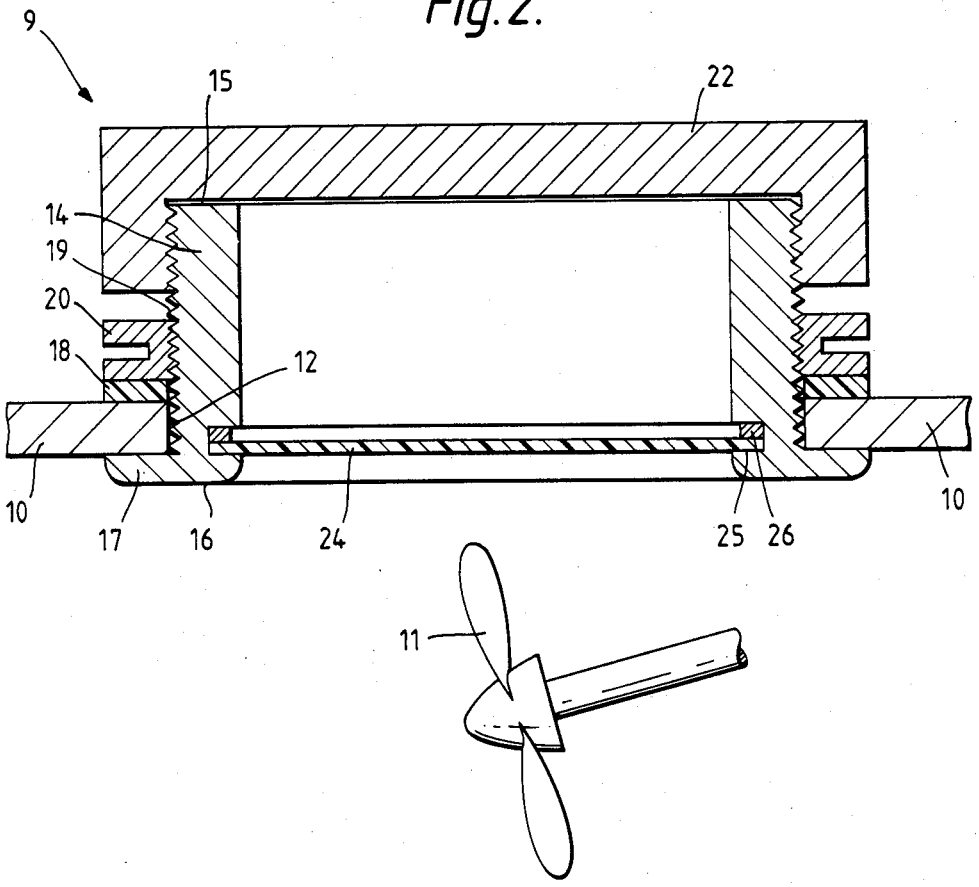

In order that the invention may more readily be understood, the following description is given, merely by way of example, reference being made to the accompanying drawing, in which:

FIG. 1 is a side elevation of one embodiment of watercraft according to the invention; and FIG. 2 is an enlarged cross-section through one embodiment of the cleaning construction according to the invention.

If reference is first made to FIG. 1, a conventional watercraft hull 6 is shown having a bow 7 and a stern 8. A propeller cleaning construction 9 of the invention is located above a portion 10 of the hull, which has one or more propellers 11 positioned therebelow.

FIG. 2 shows the construction 9 in more detail.

An aperture 12 is formd in the hull portion 10 immediately above the propeller 11. A tube 14 having an upper end 15 and a lower end 16 forms a peripheral wall, which can be passed upwardly through the aperture 10 until a radially outwardly extending flange 17 comes into contact with the outside of the hull and the tube extends into the interior of the craft, preferably with its other end 15 above the level of water when the normally loaded watercraft is in use.

To sealably attach the tube to the hull, a gasket 18 is placed around the tube, an external thread 19 on the tube 14 then has a nut 20 screwed onto it.

The upper end 15 of the tube 14, as shown in the drawing, is covered with a cap 22 which may be screwed onto the end of the tube inside the craft. This prevents material from falling into the tube and prevents excess water from entering the craft.

To seal the lower end of the tube 14, a transparent diaphragm 24 made of a pierceable, transparent plastics material, such as PVC, preferably 2 or 3 millimeters thick, is fitted into an annular internal groove 25, near the lower end 16 of the tube. A convenient method of retaining the diaphragm in place is by way of a circlip 26.

To minimize drag it is preferred that the diaphragm when fitted in the tube is flush with the outer surface of the hull.

In use, to view the propeller, one unscrews the cap 22. The transparent diaphragm 24 prevents the water from entering the craft, and the propeller shaft, which will be about thirty to forty centimeters below, may be viewed through the diaphragm. If the propeller is fouled, the diaphragm may be pierced, a blade inserted and the fouling material cut away from the propeller. Once the blade has been withdrawn from the diaphragm the cap may be replaced and the diaphragm renewed when the craft is next taken out of the water. Alternatively, the diaphragm may be replaced by a new one whilst the boat is in the water.

Instead of making the construction 9 as a separate element which can be fitted in an aperture in the boat, one could in fact build a peripheral wall to surround an aperture as an integral part of the boat, so that there would then be no need for the flange 17 or for the lower part of the external thread 19. The upper part could be threaded to accept the cap 22.

I claim:

1. A propeller clearing means for a water craft having a hull, a lower portion of said hull and a propeller located below said lower portion, said propeller clearing means comprising a cylindrical peripheral wall defining a tube having a lower end and an upper end, an interior and an exterior surface, a radially outwardly projecting flange at the lower end of said tube, an external thread formed on the exterior surface of said tube, a pierceable plastics material transparent panel extending across said lower end of the tube, and sealing the interior of the tube from the lower end, whereby said tube may be passed through an aperture formed in said lower portion of the hull above said propeller, with the radially outwardly flange abutting said portion from below, a nut threaded onto said external thread within said hull to pull said flange upwardly against said lower portion of said hull, around said aperture, a gasket sealingly surrounding said tube and sealingly engaging said lower portion of said hull, and a threaded cap threadably securable to the upper portion of said external thread.

2. A propeller clearing means for a water craft having a hull, a lower portion of said hull and a propeller located below said lower portion, said propeller clearing means comprising a cylindrical tube having a lower end and an upper end, an interior and an exterior surface, a radially outwardly projecting flange at the lower end of said tube, an external thread formed along the full length of the exterior surface of said tube, a pierceable plastics material transparent panel extending sealingly across said lower end of the tube, whereby said tube may be passed through an aperture formed in said lower portion of the hull above said propeller, with the radially outwardly flange abutting said lower portion of said hull from below, a nut threaded onto said external thread within said hull effective to pull said flange upwardly against said lower portion of said hull, around said aperture, a gasket sealingly surrounding said tube and sealingly engaging said lower portion of said hull, and a threaded cap threadably securable to the upper portion of said external thread.

3. A propeller clearing means for a motor boat having a hull, and a propeller located below a lower portion of said boat, said propeller clearing means comprising a cylindrical peripheral wall defining a tube having a lower end and an upper end, an interior and an exterior surface, a radially outwardly projecting flange at the lower end of said tube, an external thread formed on the exterior surface of said tube, a pierceable plastics material transparent panel extending across said lower end of the tube, and sealing the interior of the tube from the lower end, whereby said tube may be passed through an aperture formed in said lower portion of the hull above said propeller, with the radially outwardly flange abutting said portion from below, a nut threaded onto said external thread within said hull to pull said flange upwardly against said lower portion of said hull, around said aperture and a gasket sealingly surrounding said tube and sealingly engaging said lower portion of said hull.

4. A water craft including a hull, a lower portion of said hull, an aperture in said lower part and a propeller located below said aperture in said lower portion, said hull having a water line at a given height, a propeller cleaning construction comprising a cylindrical peripheral wall defining a tube having a lower end and an upper end, an interior and an exterior surface, a radially outwardly projecting flange at the lower end of said tube, an external thread formed along the full length of said exterior surface of said tube, a plastics material transparent panel extending across said lower end of the tube, and sealing the interior of the tube from the lower end, said tube being passed through said aperture formed in said lower portion of the hull with the radially outwardly flange abutting said portion from below, a nut threaded onto said external thread within said hull to pull said flange upwardly against said lower portion of said hull, around said aperture, a gasket sealingly surrounding said tube and sealingly engaging said lower portion of said hull, and a threaded cap threadably securable to the upper portion of said external thread, said upper end of said tube being located above the normal water line of said water craft.

5. A motor boat comprising a hull, a lower portion of said hull, an aperture formed in said lower portion of the hull and a propeller located below said lower portion, said hull having a water line at a given height above said lower portion, a propeller clearing construction including a tube having a lower end and an upper end, an interior and an exterior surface, a radially outwardly projecting flange at the lower end of said tube, an external thread formed on the exterior surface of said tube, a pierceable plastics material transparent panel extending across said lower end of the tube, and sealing the interior of the tube from the lower end, said tube being passed through said aperture formed in said lower portion of and extending upwardly whereby said upper end of the tube is above said water line, the radially outwardly flange abutting said lower portion of said hull from below, a nut threaded onto said external thread within said hull to pull said flange upwardly against said lower portion of said hull, around said aperture and a gasket sealingly surrounding said tube and sealingly engaging said lower portion of said hull.

* * * * *

UNITED STATES PATENT AND TRADEMARK OFFICE

CERTIFICATE OF CORRECTION

PATENT NO. : 4,787,870

DATED : November 29, 1988

INVENTOR(S) : John D. Britton

It is certified that error appears in the above-identified patent and that said Letters Patent is hereby corrected as shown below:

At column 1, line 11, please delete "of" (second occurrence) and insert therefor --a--;

At column 2, line 21, please delete "formd" and insert therefor --formed--; and

Signed and Sealed this

Twentieth Day of June, 1989

*Attest:*

DONALD J. QUIGG

*Attesting Officer*

*Commissioner of Patents and Trademarks*